US007592495B2

(12) United States Patent
Hessell et al.

(10) Patent No.: US 7,592,495 B2
(45) Date of Patent: Sep. 22, 2009

(54) COMPOSITIONS OF GROUP II AND/OR GROUP III BASE OILS AND ALKYLATED FUSED AND/OR POLYFUSED AROMATIC COMPOUNDS

(75) Inventors: Edward T. Hessell, Fairfield, CT (US); Richard A. Abramshe, Highland, NY (US); Lawrence V. Gallacher, Norwalk, CT (US)

(73) Assignee: King Industries, Norwalk, CT (US)

( * ) Notice: Subject to any disclaimer, the term of this patent is extended or adjusted under 35 U.S.C. 154(b) by 0 days.

(21) Appl. No.: 09/898,844

(22) Filed: Jul. 3, 2001

(65) Prior Publication Data

US 2004/0009881 A1 Jan. 15, 2004

(51) Int. Cl.
*C10M 111/02* (2006.01)
*C10M 127/06* (2006.01)

(52) U.S. Cl. ..... 585/13; 585/26; 208/19; 508/110

(58) Field of Classification Search ..... 208/19; 585/13, 26; 508/110
See application file for complete search history.

(56) References Cited

U.S. PATENT DOCUMENTS

| | | | | | |
|---|---|---|---|---|---|
| 2,427,766 | A | * | 9/1947 | Diamond | 508/572 |
| 2,764,548 | A | | 9/1956 | King et al. | 484/78 |
| 2,816,868 | A | * | 12/1957 | Moore et al. | 508/585 |
| 3,625,878 | A | * | 12/1971 | Gourlaouen et al. | 208/14 |
| 4,513,155 | A | | 4/1985 | Tamura et al. | 585/13 |
| 4,604,491 | A | | 8/1986 | Dressler et al. | 585/26 |
| 4,714,794 | A | * | 12/1987 | Yoshida et al. | 585/26 |
| 4,880,553 | A | * | 11/1989 | Kostusyk et al. | 508/588 |
| 4,992,183 | A | | 2/1991 | Beimesch et al. | 252/32.7 |
| 5,015,404 | A | | 5/1991 | Kubo et al. | 252/49.6 |
| 5,254,274 | A | * | 10/1993 | Ho et al. | 508/584 |
| 5,334,329 | A | | 8/1994 | Vinci et al. | |
| 5,342,532 | A | | 8/1994 | Takei et al. | 252/45 |
| 5,519,932 | A | | 5/1996 | Kuze | 29/564.1 |
| 5,571,445 | A | | 11/1996 | Srinivasan et al. | 508/189 |
| 5,602,086 | A | | 2/1997 | Le et al. | 508/591 |
| 5,648,108 | A | | 7/1997 | Hvidegaard | 425/426 |
| 5,792,732 | A | | 8/1998 | Jao et al. | |
| 5,935,417 | A | | 8/1999 | Cody et al. | 208/87 |
| 5,993,644 | A | * | 11/1999 | Xiao et al. | 208/89 |
| 6,074,993 | A | * | 6/2000 | Waddoups et al. | 508/364 |
| 6,300,291 | B1 | * | 10/2001 | Hartley et al. | 508/363 |
| 6,333,298 | B1 | * | 12/2001 | Waddoups et al. | 508/373 |

FOREIGN PATENT DOCUMENTS

| | | | |
|---|---|---|---|
| CA | 2 285 515 | | 4/2000 |
| DE | 482 626 | | 9/1929 |
| DE | 24 53 863 | | 5/1975 |
| EP | 0 796 908 | | 9/1997 |
| GB | 1401183 | A * | 7/1975 |
| GB | 2 168 378 | | 6/1986 |
| JP | 02286792 | A * | 11/1990 |

OTHER PUBLICATIONS

EPO Search Report.
Supplementary European Search Report issued on May 8, 2008 for EP Application No. 01953410.6.

* cited by examiner

*Primary Examiner*—Ellen M McAvoy

(57) ABSTRACT

Compositions including blends of Group II and/or Group III base oils and alkkylated fused and/or polyfused aromatic compositions, such as alkylated naphthalenes are provided. The use of such compositions, which exhibit excellent additive solvency, thermo-oxidative stability, hydrolytic stability, and seal swell characteristics, as lubricants is disclosed.

8 Claims, No Drawings

COMPOSITIONS OF GROUP II AND/OR GROUP III BASE OILS AND ALKYLATED FUSED AND/OR POLYFUSED AROMATIC COMPOUNDS

TECHNICAL FIELD

Compositions including blends of Group II and/or Group III base oils and alkylated aromatic compositions, such as alkylated naphthalenes are provided. The use of such blends, which exhibit excellent additive solvency, thermo-oxidative stability, hydrolytic stability, and seal swell characteristics, as lubricants is disclosed.

BACKGROUND

Lubricating oils are critical to the operation of the machinery of the world today.

Desirable characteristics of lubricating oils include their ability to maintain thermal and hydrolytic stability, while exhibiting swelling to seals (hereinafter "seal swell") to ensure proper functioning of the seals and to prevent loss of fluid and/or hardening of the seals as well as premature decomposition of the seals.

The use of lubricating oils in combination with various additives such as antioxidants, and wear agents, and corrosion inhibitors to provide a fluid that will meet the particular industrial oil application is known. However, in certain circumstances, the minimum performance requirements of an industrial application cannot be met by a fluid formulated from a mineral oil and commercially available additives. In such circumstances, poly-alpha-olefin (hereinafter "PAO") and combinations of the PAOs and esters have been used as a synthetic substitute by those of skill in the art. See for example U.S. Pat. Nos. 4,992,183; 5,519,932; 5,648,108; and 5,571,445. However, fluids formulated from esters and PAOs exhibit decreased thermo-oxidative and hydrolytic stability.

More recently, oil refiners have discovered that the addition of process steps, such as severe hydrotreatment, to remove any unsaturation and impurities from the oils, results in a product with improved thermal and thermo-oxidative stability compared to traditional solvent refined oils. See for example U.S. Pat. Nos. 5,935,417 and 5,993,644. Such products are referred to by those of skill in the art as Group II or Group III base oils. Table 1 below describes these base oil categories as set forth by the American Petroleum Institute's (hereinafter "APF") definition for base oils.

TABLE 1

| Base Oil Category | Sulfur | | Saturates (%) | Viscosity Index |
|---|---|---|---|---|
| Group I | >0.03 | and/or | <90 | 80 to 120 |
| Group II | ≦0.03 | and | ≧90 | 80 to 90 |
| Group III | ≦0.03 | and | ≧90 | ≧120 |
| Group IV | All Polyalpha | olefins | (POA's) | |
| Group V | All others not | included in | Groups I, II, III, or IV | |

See also API Publication 1509: Engine Oil Licensing and Certification System, "Appendix E-API Base Oil Interchangeability Guidelines for Passenger Car Motor Oil and Diesel Engine Oils".

Group II and Group III base oils, structurally different than PAO's, provide exceptional thermo-oxidative stability compared to traditional mineral base oil stocks and are more economical than PAOs. However, commonly used lubricant additives, such as amine antioxidants, phenolic antioxidants, antiwear additives, and corrosion inhibitors are less soluble in these highly saturated non-polar hydrocarbon Group II and Group III base oils. Consequently, the effectiveness of these commonly used lubricant additives is significantly reduced in Group II and Group III base oils compared to traditional mineral oils. In addition, Group II and Group III base oils lack the ability to provide swell to certain types of seals, since the refining process removes and/or destroys the naturally occurring polar compounds found in traditional solvent refined base oils that provide seal swell and compatibility. It is known in the art that these problems can be addressed by blending esters with base oils, because esters have good thermal stability as well as offer improvements both to additive solubility and seal swell characteristics. However, the addition of esters creates unacceptable hydrolytic instability in base oil/ester blends. The hydrolysis of esters to carboxylic acid in the presence of trace amounts of moisture leads to an unacceptable acceleration of base oil oxidation when used under normal conditions.

Therefore, it would be advantageous to provide a composition including Group II and/or Group III base oils which exhibits additive solvency, suitable seal swell, thermo-oxidative stability, and hydrolytic stability.

U.S. Pat. No. 5,602,086 discloses the inclusion of alkylated naphthalene blending stocks with PAO based fluids to provide desirable physical properties. It does not disclose or suggest the blending of alkylated naphthalenes with materials other than PAO, let alone that desirable physical properties could be achieved from such a blend.

Therefore, it would be unexpected that a composition including Group II and/or Group III base oils would exhibit additive solvency, suitable seal swell, thermo-oxidative stability, and hydrolytic stability.

SUMMARY

It is now surprisingly been found that compositions including Group II and/or Group III base oils blended with alkylated fused and/or polyfused aromatic compounds exhibit additive solvency and superior thermal and hydrolytic stability compared to base oils either alone or blended with esters, while maintaining seal swell characteristics similar to blends of base oils and esters.

In one embodiment, the composition includes between about 51 weight percent to about 99 weight percent of the composition Group II and/or group III base oil and between 1 weight percent to about 49 weight percent of the composition includes alkylated fused and/or polyfused aromatic compounds.

In another embodiment, suitable alkylated fused and/or polyfused aromatic compounds include, but are not limited to, anthracene, phenanthrene, pyrene, indene, benzanthrene, chrysene, triphenylene, and naphthalene. In particularly useful embodiments, the alkylated naphthalenes include at least one $C_6$ to $C_{30}$ alkyl chain.

DETAILED DESCRIPTION OF PREFERRED EMBODIMENTS

It has been found that mineral base oils can advantageously be combined with alkylated fused and/or polyfused aromatic compounds to form compositions useful as lubricants having additive solvency and superior thermal and hydrolytic stability compared to base oils either alone or blended with esters, while maintaining seal swell characteristics similar to blends of base oils and esters.

The composition which includes blends of mineral base oils and alkylated fused and/or polyfused aromatic compounds can be prepared using conventional techniques. For example, Group II and/or Group III base oils and alkylated naphthalene can be added to a reaction vessel and mixed at temperatures from about 40° C. to about 60° C. for a period of time ranging from about 20 minutes to about 2 hours. Suitable compositions have a kinematic viscosity of from about 20 to about 80 cSt and more preferably from about 44 to about 56 cSt as measured at 40° C. in accordance with ASTM test D445.

In one embodiment, the mineral base oils comprise between 51 weight percent to about 99 weight percent of the composition, with from about 60 weight percent to about 95 weight percent of the composition being preferred, and from about 80 weight percent to about 90 weight percent of the composition being most preferred. The alkylated fused and/or polyfused aromatic compounds comprise from about 1 weight percent to about 49 weight percent of the composition, and preferably from about 5 weight percent to about 40 weight percent of the composition, with from about 10 weight percent to about 20 weight percent of the composition being most preferred.

Optionally, the composition may include up to about 5 weight percent of an additive package. Suitable additive packages may contain other performance enhancing additives known in the art which include, but are not limited to, antioxidants, dispersants, antiwear additives, extreme pressure additives, rust and corrosion inhibitors, copper metal passivators, viscosity index improvers, friction modifiers and the like.

Suitable mineral base oils include Group II and/or Group III base oils and are a complex mixture of hundreds of isomers of different carbon number (generally n-parraffins, cycloparaffins, and naphthenics) and contain some small amount of unsaturation (generally less than 10%) as well as other trace impurities such a sulfur and nitrogen. As mentioned hereinabove, Group II and/or Group III base oils may be prepared in accordance with the teachings of U.S. Pat. Nos. 5,935,417 and 5,993,644, the contents of both of which are incorporated herein by reference. Typically, processes commonly used to produce conventional mineral oil base stocks known in the art are first applied to the crude oil. For example, the crude oil may be subjected to distillation, solvent dewaxing, and solvent extraction of aromatic compounds. To produce Group II and Group III base oils, the oil is then subjected to further apart processing referred to in the art as hydrotreating, hydrocracking, hydroisomerization and hydrofining. In such a process, the oil is mixed with hydrogen in a reactor in the presence of a catalyst to hydrogenate most of the double bonds or unsaturated hydrocarbons. Depending on the severity of the hydrotreatment, aromatic molecules still remaining after conventional solvent extraction are also hydrogenated to saturated ring structures. In addition, the saturated ring structures can also be ring opened to linear molecules. Most of the sulfur and nitrogen impurities are converted to hydrogen sulfide and ammonia which are removed. In some instances, the feed for this hydrotreating process is not a conventional base oil at all, but the waste products isolated during solvent dewaxing. The result is a base oil which has more n-paraffins and isoparaffins than traditional base oils, low unsaturation (generally less than 2%), very low levels of sulfur and nitrogen impurities, and a high viscosity index. Group III base oils are subjected to a more severe hydrotreating process than Group II base oils.

Suitable fused and/or polyfused aromatic compounds include, but are not limited to, anthracene, phenanthrene, pyrene, indene, acenaphthylene, benzanthrene, chrysene, triphenylene, and naphthalene, with naphthalene being preferred.

Suitable alkylated naphthalenes include these of the formula:

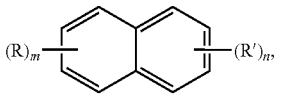

wherein R and R' are linear or branched alkyl groups of typically about $C_6$ to $C_{30}$ alkyl, such as those derived from a $C_6$ to $C_{30}$ alpha olefin alkylating agent, and m and n are independently integers from 0-4 where the sum of $m+n \geqq 1$. Preferred alkylated naphthalenes are about $C_6$ to $C_{16}$ linear or branched alkyl groups. More preferably the alkyl chain is derived from a $C_8$ to $C_{12}$ alpha olefin alkylating agent. In general, the preferred number of alkyl groups on the naphthalene ring will decrease as the length of the alkyl group increases. The alkylated naphthalene may also be a mixture of various mono, di, and higher order alkylated naphthalenes. Suitable alkylating agents include 1-octene, 1-decene, 1-dodecene, 1-tetradecene, 1-hexadecene, an isomeric mixture of branched $C_6$ to $C_{30}$ olefins, nonene, and tetrapropylene.

The alkylated naphthalenes can be prepared by any means known in the art. Suitable methods involve the alkylation of naphthalene with an olefin, alcohol, alkylhalide, or other alkylating agents known to those of skill in the art in the presence of a catalyst. Suitable catalysts include any of Lewis acid or super acid catalysts known in the art. Suitable Lewis acids include boron trifluoride, iron trichloride, tin tetrachloride, zinc dichloride, and antimony pentafluoride. Acidic clays, silica, or alumina are suitable. See for example U.S. Pat. Nos. 4,604,491 and 4,764,794. Suitable super acid catalysts include trifluoromethane sulfonic acid, hydrofluoric acid or trifluoromethylbenzene sulfonic acid. Other suitable catalysts include acidic zeolite catalysts, such as Zeolite Beta, Zeolite Y, ZSM-5, ZSM-35, and USY. In one embodiment, it is preferred to alkylate naphthalene with an olefin using aluminum chloride as the catalyst. The use of a co-catalyst such as nitromethane or nitrobenzene to promote the reaction is also suitable. See for example U.S. Pat. No. 2,754,548 to King et al. In another embodiment, it is preferred to alkylate naphthalene with an olefin using trifluoromethane sulfonic acid as the catalyst.

In another embodiment, compounds other than naphthalene may be alkylated to provide suitable alkylated naphthalenes. In particular, the addition of longer chain alkyl groups, e.g. about $C_6$ to $C_{30}$, to short chain alkylated naphthalenes, e.g. methyl naphthalene, ethyl naphthalene, propyl naphthalene, butyl naphthalene, etc. is suitable.

In order that those skilled in the art may be better able to practice the compositions and methods described herein, the following examples are given as an illustration of the blends herein. It should be noted that the invention is not limited to the specific details embodied in the examples. In addition, all percentages are weight percentages based on the total weight of the composition unless otherwise indicated.

EXAMPLES

Example 1

20% Blend of Alkylated Naphthalene in Group III Base Oil

Alkylated naphthalene I (360 grams) commercially available from King Industries, Norwalk, Conn., under the tradename NA-LUBE® KR-012 and having the physical properties listed in Table 2 hereinbelow, and 1435 grams of a 7 cSt (centistoke) Group III base oil (commercially available from Chevron Chemical Company, Richmond, Calif., under the tradename UCBO 7R) were added to a reaction vessel along with 3.6 grams of NA-LUBE® AO-140 (an amine antioxidant commercially available from King Industries, Norwalk Connectict) and 1.8 grams of NA-LUBE® AO-240 (a phenolic antioxidant commercially available from King Industries, Norwalk, Conn.). The contents of the reaction vessel were stirred at 60° C. for 20 minutes.

Example 2

20% Blend of Alkylated Naphthalene in Group III Base Oil

Alkylated naphthalene 2 (360 grams), commercially available from King Industries, Norwalk, Conn., under the tradename NA-LUBE® KX-1070 and exhibiting the physical properties listed in Table 2 hereinbelow, and 3.6 grams of a 7 cSt Group III base oil (commercially available from Chevron Chemical Company, Richmond, Calif. under the tradename UCBO-7R) were added to a reaction vessel along with 3.6 grams of NA-LUBE® AO-140 (an amine antioxidant commercially available from King Industries, Norwalk, Conn.) and 1.8 grams of NA-LUBE® AO-240 (a phenolic antioxidant commercially available from King Industries, Norwalk, Conn.). The contents of the reaction vessel were stirred at 60° C. for 20 minutes.

Example 3

Preparation of Alkylated Naphthalene 3

An alkylnaphthalene fluid, exhibiting the properties listed in Table 2 hereinbelow, was prepared by reacting 1.4 moles of tetrapropylene with 1 mole of naphthalene in the presence of 5 mole % aluminum chloride catalyst.

The reaction was quenched with an amount of water sufficient to inactivate the catalyst and the organic phase isolated. The unreacted naphthalene and olefin were removed using known distillation techniques. The treatment to remove residual reactants occurred at 200° C. for 2 hours.

Example 4

20% Blend of Alkylated Naphthalene 3 in 7 cSt Group III Oil

The alkylated naphthalene of Example 3 (360 grams) and 1435 grams of a Group III base oil (commercially available from Chevron Chemical Company, Richmond, Calif. under the tradename UCBO 7R) were added to a reaction vessel along with 3.6 grams of NA-LUBE® AO-140 (an amine antioxidant commercially available from King Industries, Norwalk, Conn.) and 1.8 grams of NA-LUBE® AO-240 (a phenolic antioxidant commercially available from King Industries, Norwalk, Conn.). The contents of the reaction vessel were stirred at 60° C. for 20 minutes.

Comparative Example 1

360 grams of a synthetic diester having a kinematic viscosity at 40° C. of 26.8 cSt (commercially available from Henkel, under the name Emery 2971) and 1435 grams of a 7 cSt Group III base oil (commercially available from Chevron Chemical Company, Richmond, Calif. under the tradename UCBO 7R) were added to a reaction vessel along with 3.6 grams of NA-LUBE® AO-140 (an amine antioxidant commercially available from King Industries, Norwalk, Conn.) and 1.8 grams of NA-LUBE® AO-240 (a phenolic antioxidant commercially available from King Industries, Norwalk, Conn.). The contents of the reaction vessel were stirred at 60° C. for 20 minutes.

Comparative Example 2

360 grams of a synthetic polyol ester based on trimethylol propane (TMP) having a kinematic viscosity at 40° C. of 19.5 cSt (commercially available from Henkel Corporation, under the name Emery 2925) and 1435 grams of a 7 cSt Group III base oil (commercially available from Chevron Chemical Company, Richmond, Calif. under the tradename UCBO 7R) were added to a reaction vessel along with 3.6 grams of NA-LUBE® AO-140 (an amine antoxidant commercially available from King Industries, Norwalk, Conn.) and 1.8 grams of NA-LUBE® AO-240 (a phenolic antioxidant commercially available from Kind Industries, Norwalk, Conn.). The contents of the reaction vessel were stirred at 60° C. for 20 minutes.

Comparative Example 3

1794.6 grams of a Group III base oil (commercially available from Chevron Chemical Company, Richmond, Calif. under the tradename UCBO 7R) were added to a reaction vessel along with 3.6 grams of NA-LUBE® AO-140 (an amine antioxidant commercially available from King Industries, Norwalk, Conn.) and 1.8 grams of NA-LUBE® AO-240 (a phenolic antioxidant commercially available from King Industries, Norwalk, Conn.). The contents of the reaction vessel were stirred at 60° C. for 20 minutes.

The physical properties of the alkylated naphthalenes of examples 1-3 are shown in Table 2 below.

TABLE 2

Physical Properties of Alkylated Naphthalenes

| Alkylated Naphthalene | 1 | 2 | 3 |
|---|---|---|---|
| Kinematic Viscosity @ 40℃ (ASTM D445) | 100 cSt | 1100 cSt | 3650 cSt |
| Kinematic Viscosity @ 100℃ (ASTM D445) | 11.1 cSt | 22.3 cSt | 42.9 cSt |
| Viscosity Index | 97 | — | — |
| Pour Point (ASTM D97) | −23℃ | 3℃ | Greater than 10 |
| Aniline Point (ASTM D611) | 55℃ | 42℃ | — |

TABLE 3

| | Compositions of Examples | | | | | |
|---|---|---|---|---|---|---|
| Example | 1 | 2 | 4 | Comparative 1 | Comparative 2 | Comparative 3 |
| 7 cSt Group III Base Oil | 79.7% | 79.7% | 79.7% | 79.7% | 79.7% | 79.7% |
| Alkylated Naphthalene 1 | 20% | | | | | |
| Alkylated Naphthalene 2 | | 20% | | | | |
| Alkylated Naphthalene 3 | | | 20% | | | |
| Synthetic Diester | | | | 20% | | |
| Synthetic Polyol Ester | | | | | 20% | |
| Amine Antioxidant (NA LUBE ® AO-140) | 0.2% | 0.2% | 0.2% | 0.2% | 0.2% | 0.2% |
| Phenolic Antioxidant (NA LUBE ® AO-240) | 0.1% | 0.1% | 0.1% | 0.1% | 0.1% | 0.1% |
| Kinematic Viscosity @ 40℃ (ASTM D445) | 44.9 | 51.2 | 56 | 38.1 | 34.4 | 32.3 |
| Kinematic Viscosity @ 100℃ (ASTM D445) | 7.4 | 7.6 | 8 | 6.8 | 6.3 | 6.1 |
| Viscosity Index | 130 | 112 | 110 | 137 | 137 | 138 |
| Pour Point, ℃ (ASTM D-97) | −21 | −24 | −21 | −18 | −21 | −18 |

The thermal stability of the compositions of Examples 1, 2 and 4 and Comparative Examples 1-3 were evaluated using Federal Test Method 3411. In this test, the oils were heated at 274° C. for 96 hours in a sealed tube in the absence of moisture and air, but in the presence of a steel coupon. The changes in viscosity, acid number, and discoloration and corrosion of the steel coupon are all indicative of oil decomposition. The results of the tests are reported in Table 4 below. They show that there are no adverse effects incurred by the inclusion of alkylated naphthalenes in the Group II base oil formulation. Conversely, incorporation of synthetic esters leads to undesirable losses in viscosity, increase in acid number, and discoloration of the steel coupon.

TABLE 4

| | FTM-3411 Thermal Stability | | | | | |
|---|---|---|---|---|---|---|
| Example | 1 | 2 | 4 | Comparative 1 | Comparative 2 | Comparative 3 |
| Change in Viscosity | −0.80% | 1.42% | 0.65% | −15.78% | −10.02% | −0.86% |
| Change in Acid Number | −0.03% | −0.02 | −0.02 | 0.52 | 5.97 | 0.03 |
| Change in Metal Weight, mg/cm$^2$ | −0.008 | 0.008 | −0.017 | 0.050 | −2.970 | 0.000 |
| Appearance | Shiny | Shiny | Shiny | Blue-Black | Shiny | Etched Gold-Shiny |
| Oil Appearance | Light Amber | Medium Amber | Medium Amber | Very Dark Amber | Black | Clean |
| Test Cell Appearance | Clean | Clean | Clean | Clean | Heavy Black Stains | Clean |
| Sediment | Trace | Light | Very Light | Light | Sediment | Clean |

The seal swelling characteristics of compositions of Examples 1, 2, and 4 Comparative Examples 1-3 on two materials commonly used in seals were evaluated by the AST D 417 and ASTM D 2240 methods, Seal Swell and Percent Hardness Change, respectively.

Coupons of the 1sealxmaterials tested, i.e. nitrile rubber (NBR) commercially available from Test Engineering, Cimerron Path, San Antonio, Tex. and Fluoroelastomer (also commercially available from Test Engineering, Cimerron Path, San Antonio, Tex., as Viton F975) were immersed in the compositions of Example 1, 2, 4 and Comparative Examples 1-3 for 70 hours, at 100° C. for the NBR seal and at 150° C. for the Viton F975, respectively. The volume and hardness of the sample coupons were measured before and after the test and the percent change recorded. Specifications for the desired degree of seal swell depend on the particular application, but typical values are in the range of 3-15% for NBR and very little or no change for Fluoroelastomer. Any significant change in the hardness (negative or positive) is considered detrimental to the function and service life of the seal. The results reported in Table 5 illustrate that both NBR and Fluoroelastomer seals exposed to the compositions of Examples 1, 2 and 4, i.e. the compositions containing blends of alkylated naphthalenes and base oils, exhibited a desirable degree of swell compared to the base oils alone (which exhibit little or no swell). Moreover, both NBR and Fluoroelastomer seals exposed to the compositions of Examples 1, 2 and 4 exhibit seal swell comparable to NBR and Fluoroelastomers seals exposed to the compositions of Comparative Examples 1-2, i.e., blends of base oils and synthetic esters.

TABLE 5

Seal Swell and Percent Hardness

| Example | 1 | 2 | 4 | Comparative 1 | Comparative 2 | Comparative 3 |
|---|---|---|---|---|---|---|
| 70 hrs @ 100℃, Nitrile Buna-N | | | | | | |
| ASTM D-417 Swell | 5.71% | 9.92% | 8.92% | 11.08% | 12.53% | 2.33% |
| ASTM D-2240 % Hardness | −2 | −5 | −5 | −10 | −10 | 0 |
| 70 hrs @ 150℃, Fluoro-elastomer, F975, (MT-1 Spec) | | | | | | |
| ASTM D-417 Swell | 0.23% | 0.31% | 0.31% | 0.83% | 1.05% | 0.11% |
| ASTM D-2240 % Hardness | −1 | −1 | −1 | 0 | 0 | 1 |

See American Petroleum Institute Publication 1560 Lubricant Service Designations for Automotive Manual Transmissions, Manual Transaxles, and Axles, 7th edition, 1995.

The hydrolytic stability of compositions of Examples 1, 2, 4 and Comparative Examples 1-3 was evaluated by the ASTM D 2619 Hydrolytic Stability Test. 75 grams of Example 1 were placed in a sealed bottle along with 25 grams of water in the presence of a copper strip and rotate and heated at 93° C. for 48 hours. Compositions of Examples 2 and 4 and Comparative Examples 1-3 were subjected to the same treatment, respectively. The acidity of the water layer of each sample was measured to determine the degree of hydrolysis of the compositions. The weight loss and discoloration of the copper strip in each bottle was measured. The data set forth below in Table 6 indicates that the extent of the hydrolysis is minimal compared to Comparative Example 3, i.e. base oil not blended with any modifier. The degree of hydrolysis of the compositions of the Comparative Examples 1-2, which contain esters blended with base oils, indicates that the use of esters has a detrimental effect of the hydrolytic stability of the overall formulation compared to either unblended base oils or the compositions of Examples 1, 2 and 4. Therefore, the compositions containing the alkylated naphthalenes as base oil modifiers are an improvement over similar compositions blended with synthetic esters.

TABLE 6

ASTM D 2619 Hydrolytic Stability

| Example | 1 | 2 | 4 | Comparative 1 | Comparative 2 | Comparative 3 |
|---|---|---|---|---|---|---|
| Acid Number Of Water Layer in mg KOH/g | 1.5 | 2.7 | 2 | 7.1 | 7.2 | <1 |

As the data in Tables 4, 5 and 6 illustrate, the compositions including alkylated naphthalenes and base oils exhibit seal swell characteristics similar to compositions containing esters and base oils, while providing superior thermal and hydrolytic stability.

Example 5

Blend of 75% of 7 cSt Group II Base Oil and 25% Alkylated Naphthalene 1

Alkylated naphthalene 1 (25 grams), commercially available from King Industries, Norwalk, Conn., under the tradename NA-LUBE® KR-012 and 75 grams of a 7 cSt (□entistokes) Group III base oil (commercially available from Chevron Chemical Company, Richmond, Calif., under the tradename UCBO 7R) were added to a reaction vessel. The contents of the reaction vessel were stirred at 60° C. for 20 minutes.

Example 6

Blend of 50% Alkylated Naphthalene and 50% Group III Base Oil

Alkylated naphthalene 1 (50 grams), commercially available from King Industries, Norwalk, Conn., under the tradename NA-LUBE® KR-012 and 50 grams of a 7 cSt (centistokes) Group III base oil (commercially available from Chevron Chemical Company, Richmond Calif., under the tradename UCBO 7R) were added to a reaction vessel and stirred at 60° C. for 20 minutes.

Example 7

Blend of 75% Alkylated Naphthalene and 25% Group III Base Oil

Alkylated naphthalene 1 (75 grams), commercially available from King Industries, Norwalk, Conn., under the tradename NA-LUBE® KR-012 and 25 grams of a 7 cSt (centistokes) Group III base oil (commercially available from Chevron Chemical, Richmond Calif., under the tradename UCBO 7R) were added to a reaction vessel and stirred at 60° C. for 20 minutes.

Example 8

Blend of 25% Alkylated Naphthalene 2 and 75% Group III Base Oil

Alkylated naphthalene 2 (25 grams), commercially available from King Industries, Norwalk, Conn., under the tradename NA-LUBE® KX-1070 and 75 grams of a 7 cSt Group III base oil (commercially available from Chevron Chemical Company, Richmond Calif. under the tradename UCBO 7R) were added to a reaction vessel and stirred at 60° C. for 20 minutes.

Example 9

Blend of 50% Alkylated Naphthalene 2 and 50% Group III Base Oil

Alkylated naphthalene 2 (50 grams), commercially available from King Industries, Norwalk, Conn., under the tradename NA-LUBE® KX-1070 and 50 grams of a 7 cSt Group III base oil (commercially available from Chevron Chemical Company, Richmond Calif. under the tradename UCBO 7R) were added to a reaction vessel and stirred at 60° C. for 20 minutes.

Example 10

Blend of 75% Alkylated Naphthalene 2 and 25% Group III Base Oil

Alkylated naphthalene 2 (75 grams), commercially available from King Industries, Norwalk, Conn., under the tradename NA-LUBE® KX-1070 and 25 grams of a 7 cSt Group III base oil (commercially available from Chevron Chemical Company, Richmond Calif. under the tradename UCBO 7R) were added to a reaction vessel and stirred at 60° C. for 20 minutes.

Example 11

Blend of 20% Alkylated Naphthalene 1 and 80% of 7 cSt Group III Base Oil

Alkylated naphthalene I (2 grams), commercially available from King Industries, Norwalk, Conn., under the tradename NA-LUBE® KR-012 and 8 grams of a 7 cSt Group III base oil (commercially available from Chevron Chemical Company, Richmond Calif. under the tradename UCBO 7R) were added to a reaction vessel and stirred at 60° C. for 20 minutes.

Example 12

Blend of 20% Alkylated Naphthalene 2 and 80% Group III Base Oil

Alkylated naphthalene 2 (2 grams), commercially available from King Industries, Norwalk, Conn., under the tradename NA-LUBE® KX-1070 and 8 grams of a 7 cSt Group III base oil (commercially available from Chevron Chemical Company, Richmond Calif. under the tradename UCBO 7R) were added to a reaction vessel and stirred at 60° C. for 20 minutes.

Example 13

Blend of 20% Alkylated Naphthalene 3 and 80% Group III Base Oil

The alkylated naphthalene 3 of example 3 (2 grams) and 8 grams of a 7 cSt Group III base oil (commercially available from Chevron Chemical Company, Richmond Calif. under the tradename UCBO 7R) were added to a reaction vessel and stirred at 60° C. for 20 minutes.

Comparative Example 4

A 7 cSt Group III base oil (commercially available from Chevron Chemical Company, Richmond Calif., under the tradename UCBO 7R) was used as Comparative Example 4.

Comparative Example 5

Alkylated naphthalene 1, commercially available from King Industries, Norwalk, Conn., under the tradename NA-LUBE® KR-012 was used as Comparative Example 5.

Comparative Example 6

Alkylated naphthalene 2, commercially available from King Industries, Norwalk, Conn., under the tradename NA-LUBE® KX-1070 was used as Comparative Example 6.

Comparative Example 7

A synthetic diester having a kinematic viscosity at 40° C. of 26.8 cSt (available from Henkel corporation as Emery 2925) was used as Comparative Example 7.

Comparative Example 8

A synthetic polyol ester based on trimethylol propane (TMP) having a kinematic viscosity at 40° C. of 19.5 cSt (available from Henkel Corporation as Emery 2970) was used as Comparative Example 8.

Thermo-Oxidative Stability

Tables 7 and 8 below set forth the thermo-oxidative stability of the alkylated naphthalenes in combination with a Group III base oil at various concentrations as determined using the ASTM 2272 Rotory Bomb Oxidation (RBOT) method and Pressure Differential Scanning Calorimetry (PDSC).

The RBOT test utilizes an oxygen-pressure bomb to evaluate the oxidation stability of oils in the presence of water and a copper catalyst coil at 150° C. The test oil, water and a copper catalyst coil, contained in a covered glass container, are placed in a bomb equipped with a pressure gauge. The bomb is charged with oxygen to a pressure of 90 psi, placed in a constant temperature oil bath at 150° C., and rotated axially at 100 rpm at an angle of 30° from the horizontal. The time period required for the pressure to drop to 25 psi is the measure of the oxidation stability of the test sample. The longer the time, the better the oxidation stability of the material.

The thermo-oxidative stability of various blends of alkylated naphthalenes and Group III base oil were also evaluated by PDSC. This is a calorimetric test that measures the induction time to an exotherm or endotherm under specific conditions of temperature and atmosphere. The exotherm or endotherm is associated with decomposition of the sample. The heat flow as a function of time is charted on a two dimensional graph with the "x" axis being time (minutes) and the "y" axis being heat flow (watts/g). Under conditions where no decomposition occurs a horizontal line is plotted (i.e., slope equals zero). The induction time corresponds to the point on the graph where the slope becomes positive.

A TA Instruments Model 910 PDSC interfaced to a Series 2000 Thermal Analyst computer was employed. Iso-Trak™ control mode was used for highest sensitivity. Samples were weighed into open aluminum pans and heated at a rate of 40° C./min. to a target temperature and then held isothermally until an exotherm was observed. Data was collected at both 160° C. and 170° C. An atmosphere of 150 psi pure air was used for all tests.

TABLE 7

Summary of RBOT and PDSC Oxidative Induction Times for Blends of Alkylated Naphthalene 1 and 7 cSt Group III Base Oil

| Blend | Percent 7 cSt Group III Base Oil | Percent Alkylated Naphthalene 1 | RBOT Induction Time (Minutes) | PDSC (160 C. isothermal) Induction Time (Minutes) |
|---|---|---|---|---|
| Comparative Example 4 | 100 | 0 | 18 | 1 |
| Example 5 | 75 | 25 | 35 | 22 |
| Example 6 | 50 | 50 | 63 | 82 |
| Example 7 | 25 | 75 | 71 | — |
| Comparative Example 5 | 0 | 100 | 83 | 84 |

TABLE 8

Summary of RBOT and PDSC Oxidative Induction Times for Blends of Alkylated Naphthalene 2 and Group III Base Oil

| Blend | Percent 7 cSt Group III Base Oil | Percent Alkylated Naphthalene 2 | RBOT Induction Time (Minutes) | PDSC (160 C. isothermal) Induction Time (Minutes) | PDSC (170 C. isothermal) Induction Time (Minutes) |
|---|---|---|---|---|---|
| Comparative Example 4 | 100 | 0 | 18 | 1 | <1 |
| Example 8 | 75 | 25 | 62 | 69 | 20 |
| Example 9 | 50 | 50 | 95 | 83 | — |
| Example 10 | 25 | 75 | 138 | 102 | 91 |
| Comparative Example 6 | 0 | 100 | 242 | >>130 | 129 |

The results reported in Tables 7 and 8 clearly indicate that 1) the thermo-oxidative stability of the base oil blends increases with increasing concentration of the alkylated naphthalene and 2) that there is an improvement in thermo-oxidative stability even at low concentrations of the alkylated naphthalenes.

The improvement in thermo-oxidative stability of combinations of alkylated napthalenes with Group III base oils over combinations of other base oil modifiers with Group III base oils is further illustrated by the data in Table 9. Blends of 20 weight % of various alkylated naphthalenes in Group III base oil exhibit improvement in induction time over the 7 cSt base oil alone (Comparative Example 4), and the combination of esters with Group III base oils (Comparative Examples 7 and 8).

TABLE 9

Pressure Differential Scanning Calorimetry Induction Times at 160° C. for Blends of 20 wt % of the in 7 cSt Group III Oil

| Additive at 20 wt % in 7 cSt Group III Base Oil | Induction Time (minutes) |
|---|---|
| Comparative Example 4 | 0 |
| Example 11 | 18 |
| Example 12 | 48 |
| Example 13 | >80 |
| Comparative Example 7 | 0 |
| Comparative Example 8 | 0 |

It will be understood that various modifications may be made to the embodiments disclosed herein. For example, alkylated fused and/or polyfused aromatic compounds may possess functional groups in addition to alkyl groups. Therefore, the above description should not be construed as limiting, but merely as exemplifications of preferred embodiments. Those skilled in the art will envision other modifications within the scope of the claims appended hereto.

What is claimed is:

1. A composition consisting of:

a mixture of 50 weight percent to about 90 weight percent of Group III base oils and alkylated naphthalene, wherein the alkylated naphthalene contains at least naphthalene alkylated by at least two alkyl chains, wherein each alkylate moiety is a $C_6$ to $C_{30}$ alkyl chain.

2. The composition of claim 1, wherein the $C_6$ to $C_{30}$ alkyl chain is derived from an alpha olefin alkylating agent.

3. The composition of claim 1, wherein the alkyl chain is a $C_6$ to $C_{16}$ alkyl chain.

4. The composition of claim 1, wherein the alkyl chain is a $C_8$ to $C_{12}$ alkyl chain.

5. The composition of claim 1, wherein the alkyl chain is derived from 1-octene.

6. The composition of claim 1, wherein the alkyl chain is derived from 1-decene.

7. The composition of claim 1, wherein the alkyl chain is derived from 1-dodecene.

8. The composition of claim 1, wherein the alkyl chain is selected from the group consisting of 1-tetradecene, 1-hexadecene, an isomeric mixture of branched $C_6$ to $C_{30}$ olefins, and tetrapropylene.

* * * * *